US011207769B2

(12) United States Patent
Koizumi

(10) Patent No.: US 11,207,769 B2
(45) **Date of Patent: *Dec. 28, 2021**

(54) HYDRAULIC HAMMERING DEVICE

(71) Applicant: Furukawa Rock Drill Co., Ltd., Tokyo (JP)

(72) Inventor: Masahiro Koizumi, Gunma (JP)

(73) Assignee: Furukawa Rock Drill Co., Ltd., Tokyo (JP)

( * ) Notice: Subject to any disclaimer, the term of this patent is extended or adjusted under 35 U.S.C. 154(b) by 247 days.

This patent is subject to a terminal disclaimer.

(21) Appl. No.: 16/477,355

(22) PCT Filed: Jan. 12, 2018

(86) PCT No.: PCT/JP2018/000703

§ 371 (c)(1),
(2) Date: Jul. 11, 2019

(87) PCT Pub. No.: WO2018/131689

PCT Pub. Date: Jul. 19, 2018

(65) Prior Publication Data

US 2020/0391368 A1 Dec. 17, 2020

(30) Foreign Application Priority Data

Jan. 12, 2017 (JP) ..... JP2017-003065

(51) Int. Cl.
*B25D 9/12* (2006.01)
*E21B 1/38* (2006.01)
*B25D 9/26* (2006.01)

(52) U.S. Cl.
CPC ..... *B25D 9/12* (2013.01); *B25D 9/26* (2013.01); *E21B 1/38* (2020.05)

(58) Field of Classification Search
CPC ... B25D 9/12; B25D 9/26; B25D 9/16; B25D 9/145; E21B 1/38; E21B 1/26; E21B 1/00
(Continued)

(56) References Cited

U.S. PATENT DOCUMENTS 3,411,592 A 11/1968 Montabert
3,916,764 A 11/1975 Crover
(Continued)

FOREIGN PATENT DOCUMENTS

DE 44 24 080 C1 1/1996
JP S47-13595 B1 5/1972
(Continued)

OTHER PUBLICATIONS

Co-Pending U.S. Appl. No. 15/742,832, filed Jan. 8, 2018.
(Continued)

*Primary Examiner* — Valentin Neacsu
(74) *Attorney, Agent, or Firm* — Young Basile Hanlon & MacFarlane, P.C.

(57) ABSTRACT

A hydraulic hammering device includes a piston front chamber and a piston rear chamber defined between an outer circumferential surface of the piston and an inner circumferential surface of the cylinder and disposed separately from each other at front and rear, respectively, in an axial direction. A switching-valve mechanism drives the piston by switching at least one of the piston front chamber and the piston rear chamber into communication with at least one of a high pressure circuit and a low pressure circuit. An acceleration piston is disposed behind the piston and is configured to come into contact with the piston during a retreat stroke thereof to urge the piston forward, in which a timing where the acceleration piston itself starts to come in contact with the piston is set to be earlier than a timing where the piston is braked by the switching-valve mechanism.

16 Claims, 6 Drawing Sheets

(58) Field of Classification Search
USPC ..... 170/90, 208
See application file for complete search history.

(56) References Cited

U.S. PATENT DOCUMENTS

| | | | | |
|---|---|---|---|---|
| 4,111,269 | A | 9/1978 | Ottestad | |
| 4,172,411 | A | 10/1979 | Matsuda et al. | |
| 4,349,075 | A * | 9/1982 | Henriksson | B25D 9/26 173/208 |
| 4,747,455 | A | 5/1988 | Cunningham | |
| 4,951,757 | A | 8/1990 | Hamada et al. | |
| 5,279,120 | A | 1/1994 | Sasaki | |
| 5,392,865 | A * | 2/1995 | Piras | B25D 9/145 173/17 |
| 5,718,297 | A * | 2/1998 | Weber | B25D 9/145 173/112 |
| 8,151,901 | B2 * | 4/2012 | Keskiniva | B25D 9/125 173/90 |
| 2004/0144551 | A1 | 7/2004 | Koskimaki | |
| 2004/0251038 | A1 | 12/2004 | Rantala et al. | |
| 2010/0283315 | A1 | 11/2010 | Isono | |
| 2014/0209340 | A1 | 7/2014 | Moore | |
| 2015/0375383 | A1 | 12/2015 | Autschbach et al. | |
| 2016/0039080 | A1 | 2/2016 | Moore et al. | |
| 2017/0001293 | A1 * | 1/2017 | Matsuda | B25D 9/20 |
| 2018/0207782 | A1 | 7/2018 | Koizumi | |
| 2020/0181978 | A1 * | 6/2020 | Koizumi | B25D 9/26 |

FOREIGN PATENT DOCUMENTS

| | | | |
|---|---|---|---|
| JP | S52-100303 | A | 8/1977 |
| JP | S56-89478 | U | 7/1981 |
| JP | S57-008091 | A | 1/1982 |
| JP | S59-156677 | A | 9/1984 |
| JP | S61-75982 | U | 5/1986 |
| JP | S63-013672 | U | 1/1988 |
| JP | H03-062777 | U | 6/1991 |
| JP | H04-93185 | A | 3/1992 |
| JP | 2000-176859 | A | 6/2000 |
| JP | 2008-036746 | A | 2/2008 |
| JP | 4912785 | B2 | 4/2012 |
| WO | 98/031509 | A1 | 7/1998 |
| WO | 2017/010400 | A1 | 1/2017 |

OTHER PUBLICATIONS

English translation of the International Preliminary Report on Patentability in corresponding Internationa Application No. PCT/JP2018/000703, dated Jul. 25, 2019, 10 pgs.

Wikipedia, "Hydraulic fluid", retrieved from "https://en.wikipedia.org/w/index.php?title=Hydraulic_fluid&oldid=725039375", 6 pgs.

Extended European Search Report in corresponding European Patent Application No. 18739319.4, dated Dec. 16, 2019, 7 pgs.

Extended European Search Report in European Patent Application No. 16824380.6, dated Feb. 13, 2019, 6 pgs.

English Translation of the International Preliminary Report On Patentability in related International Patent Application No. PCT/JP2016/070155, dated Jan. 25, 2018, 8 pgs.

Definition of "Another", by Merriam Webster Dictionary, retrieved from URL https://www.merriam-webster.com/dictionary/another on Sep. 15, 2020 (Year:2020).

English Translation of the International Preliminary Report On Patentability in International Patent Application No. PCT/JP2016/070155, dated Jan. 25, 2018, 8 pgs.

* cited by examiner

HYDRAULIC HAMMERING DEVICE

CROSS-REFERENCE TO RELATED APPLICATION

This application claims priority to JP Patent Application No. 2017-3065, filed Jan. 12, 2017, the entire content of which is incorporated herein in its entirety by reference.

TECHNICAL FIELD

The present invention relates to a hydraulic hammering device, such as a rock drill and a breaker.

BACKGROUND

JP Pat. No. 4912785 describes an art disclosed as an example of this type of hydraulic hammering device. The hydraulic hammering device described in the document is provided with a cylinder 100P, a front head 300, and a back head 400P, and a piston 200 slidingly fitted in the cylinder 100P, as illustrated, for example, in FIG. 8.

The front head 300 is disposed in front of the cylinder 100, and a rod 310 is slidingly fitted so as to be movable backwards and forwards. In the front head 300, a hammering chamber 301 is formed, in which the rear end of the rod 310 is hammered by the front end of the piston 200 in the hammering chamber 301. The back head 400P, disposed behind the cylinder 100, includes a retreat chamber 401P formed therein, in which the rear end part of the piston 200 moves backwards and forwards.

The piston 200 is a solid cylindrical body, having large-diameter sections 201 and 202 in an approximately middle region thereof. A medium-diameter section 203 is provided in front of the large-diameter section 201, and a small-diameter section 204 is provided behind the large-diameter section 202. A ring-shaped valve-switching groove 205 is formed in an approximately middle region between the large-diameter sections 201 and 202. The outer diameter of the medium-diameter section 203 of the piston is set larger than that of the small-diameter section 204 of the piston.

As a result, regarding a pressure-receiving area of the piston front chamber 110 formed by a diametrical difference between the large-diameter section 201 and the medium-diameter section 203 and a pressure-receiving area of the piston rear chamber 111 formed by a diametrical difference between the large-diameter section 202 and the small-diameter section 204, the pressure-receiving area of the piston rear chamber 111 side is larger (hereinafter, a difference between the pressure receiving-areas of the piston front chamber 110 and the piston rear chamber 111 is referred to as "pressure-receiving area difference").

The piston 200, slidingly fitted in the cylinder 100, defines the piston front chamber 110 and the piston rear chamber 111 within the cylinder 100. The piston front chamber 110 is always connected to a high pressure circuit 101 via a piston front chamber passage 120. On the other hand, the piston rear chamber 111 can communicate with either the high pressure circuit 101 or a low pressure circuit 102 via a piston rear chamber passage 121 by the switching operation of a switching-valve mechanism 130 to be described later.

The high pressure circuit 101 is connected to a pump P, and a high pressure accumulator 140 is provided in the middle of the high pressure circuit 101. The low pressure circuit 102 is connected to a tank T, and a low pressure accumulator 141 is provided in the middle of the low pressure circuit 102. The switching-valve mechanism 130 is a known switching valve disposed in a suitable position inside or outside the cylinder 100P, and operates with the aid of pressurized oil supplied/discharged via a valve-control passage 122 to be described later, thereby switching high and low pressures in the piston rear chamber 111 alternatingly.

A piston-advancing control port 112, a piston-retreating control port 113, and an oil-discharging port 114 are provided from front toward rear separately from each other at a certain interval between the piston front chamber 110 and the piston rear chamber 111. The piston-advancing control port 112 and the piston-retreating control port 113 are connected to respective passages branched from the valve-control passage 122. The oil-discharging port 114 is connected to the tank T via an oil-discharging passage 123.

The piston-advancing control port 112 has an anterior short-stroke port 112*a* and a posterior long-stroke port 112*b*, which are used for switching between short stroke and long stroke steplessly by operating a variable throttle 112*c* provided between the short-stroke port 112*a* and the valve-control passage 122. The fully opened variable throttle 112*c* causes a short stroke and the fully closed throttle causes a long stroke.

In this hydraulic hammering device, the piston front chamber 110 is always connected to the high pressure circuit 101, thereby always urging the piston 200 backward; when the piston rear chamber 111 is connected to the high pressure circuit 101 owing to the operation of the switching-valve mechanism 130, the piston 200 advances owing to the pressure-receiving area difference, and when the piston rear chamber 111 is connected to the low pressure circuit 102 owing to the operation of the switching-valve mechanism 130, the piston 200 retreats.

When the piston-advancing control port 112 communicates with the piston front chamber 110 to supply pressurized oil to the valve-control passage 122, the switching-valve mechanism 130 is switched to a position so as to make the piston rear chamber passage 121 communicate with the high pressure circuit 101. In addition, when the piston-retreating control port 113 communicates with the oil-discharging port 114 to discharge pressurized oil from the valve-control passage 122 to the tank T, the switching-valve mechanism 130 is switched to a position so as to make the piston rear chamber passage 121 communicate with the low pressure circuit 102.

BRIEF SUMMARY

Methods of improving the power of this type of hydraulic hammering device include a method for increasing its kinetic energy per stroke and a method for increasing its hammering frequency to increase its total kinetic energy. Between these methods, the present inventor has found the following problem in the method for increasing the hammering frequency to increase its total kinetic energy.

In FIG. 8, a conventional hydraulic hammering device has been explained which is provided with the piston-advancing control port 112 including both the long-stroke port 112*b* and the short-stroke port 112*a*, and the shortened stroke of the device enables more hammering frequency than in the long-stroke setting thereof.

FIG. 9 illustrates a piston displacement-speed charts for the long stroke and the short stroke of a conventional hydraulic hammering device.

In the figure, the dotted line is a chart for the long stroke setting, and L1 is a whole stroke, L2 is a section for acceleration of retreating piston (after the piston starts retreating until the piston-advancing control port communicates with the piston front chamber and the switched valve switches the piston rear chamber into a high pressure state), L3 is a section for deceleration of retreating piston (after the piston rear chamber is switched into a high pressure state until the piston reaches a backward stroke end), and Vlong is a piston speed at the hammering point. In addition, the solid line is a chart for the short-stroke setting, and also in the dotted line, L1' is a whole stroke, L2' is a section for acceleration of retreating piston, L3' is a section for deceleration of retreating piston, and Vshort is a piston speed at the hammering point.

It can be understood from FIG. 9 that although the short-stroke setting can shorten the stroke, the section for accelerating the piston also decreases, resulting in the decrease of the piston speed from Vlong to Vshort. Accordingly, upon taking as a whole into account the increase in the hammering frequency achieved by the shortened stroke and the decrease in the piston speed, the short-stroke setting does not necessarily lead to the power improvement. If the hammering pressure does not change (because hammering energy is proportional to stroke, and the hammering frequency is inversely proportional to the square root of the stroke), the hammering output decreases in proportion to the square root of the piston stroke as the stroke becomes shorter.

In addition, in the conventional hydraulic hammering device, when further shortening the stroke, the position of the piston-advancing control port will be shifted forward. Herein, when focusing on a circuit state of the front chamber and the piston-advancing control port at the time of hammering, the front chamber is connected to high pressure, whereas the piston-advancing control port is connected to low pressure, and the front chamber and the piston-advancing control port are sealed by the piston large-diameter section. When the position of the piston-advancing control port is shifted forward, a seal length between the piston-advancing control port and the front chamber becomes short, causing a problem where leakage increases, and thereby efficiency is reduced. This indicates a limitation in changing of the position of the port, i.e., short stroking by changing of hydraulic circuit arrangement.

Therefore, the present invention has been made in view of such a problem, and an object thereof is to provide a hydraulic hammering device capable of improving hammering power by shortening its piston stroke, without changing hydraulic circuit arrangement and while keeping its hammering energy.

In order to achieve the object mentioned above, according to one aspect of the present invention, there is provided a hydraulic hammering device including: a cylinder; a piston slidingly fitted in the cylinder; a piston front chamber and a piston rear chamber which are defined between an outer circumferential surface of the piston and an inner circumferential surface of the cylinder and disposed separately from each other at front and rear, respectively, in an axial direction of the piston; a switching-valve mechanism driving the piston by switching at least one of the piston front chamber and the piston rear chamber into communication with at least one of a high pressure circuit and a low pressure circuit; and a piston control port arranged between the piston front chamber and the piston rear chamber of the cylinder and connected to/disconnected from the high pressure circuit and the low pressure circuit by forward movement/backward movement of the piston, the switching-valve mechanism being driven by pressurized oil supplied/discharged from the piston control port, wherein the hydraulic hammering device comprises an urging unit disposed behind the piston and configured to come in contact with the piston during a piston retreat stroke to urge the piston forward, in which a timing where the urging unit starts to comes in contact with the piston is set to be earlier than a timing where the piston is braked by the switching-valve mechanism.

According to the hydraulic hammering device according to the one aspect of the present invention, the urging unit is disposed behind the piston, which urging unit comes in contact with the piston at the timing where braking force acts on the piston during a piston retreat stroke to urge the piston forward. Thus, the piston retreat stroke is shortened, and also the piston advance operation is accelerated, so that the piston speed is not reduced, thus enabling high output. In this case, if the pressure-receiving area of the urging unit does not change, the amount of shortening of the retreat stroke is determined depending on a contact position between the piston and the urging unit. Thus, it is unnecessary to change the arrangement of a hydraulic circuit such as the piston control port, and also there occurs no efficiency reduction due to reduced seal length.

According to the present invention, it is possible to provide a hydraulic hammering device capable of improving hammering power by shortening its piston stroke, without changing hydraulic circuit arrangement and while keeping its hammering energy.

DETAILED DESCRIPTION

Hereinafter, respective embodiments and modifications of the present invention will be described with reference to the drawings as appropriate. In all of the drawings, the same components are assigned with the same signs. The drawings are schematic. Therefore, it should be noted that a quantity such as the relation or ratio of thickness to surface dimension may be different from the actual one, and the dimensional relation and ratio of parts illustrated in respective drawings may be different from those in another drawing. In addition, each of the embodiments illustrated below exemplifies a device and a method for embodying a technical concept of the present invention, which does not limit the material, shape, structure, arrangement, etc. of component parts to those in embodiments below.

Figure 1:
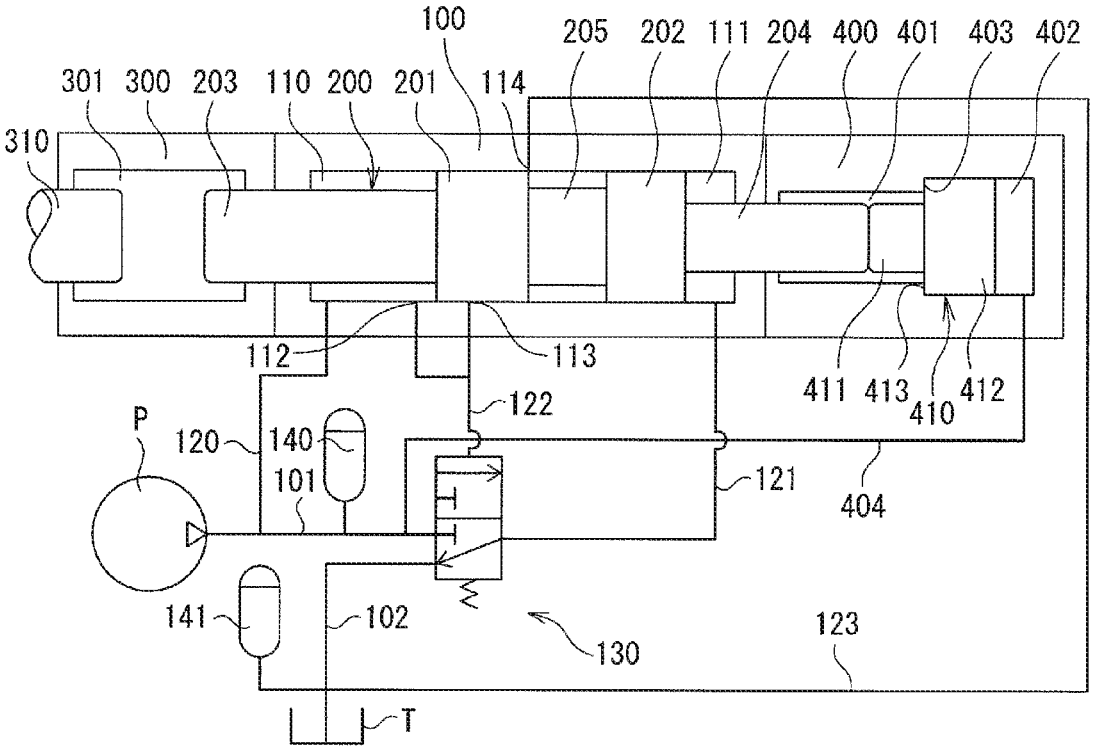
FIG. 1 is a schematic diagram of the first embodiment of a hydraulic hammering device according to an aspect of the present invention.

As illustrated in FIG. 1, the hydraulic hammering device of the first embodiment includes a cylinder 100, a front head 300, a back head 400, and a piston 200 slidingly fitted in the cylinder 100.

The piston 200 is a solid cylindrical body, having large-diameter sections 201 and 202 in an approximately middle region thereof. The piston has a medium-diameter section 203 provided in front of the large-diameter section 201 and a small-diameter section 204 provided behind the large-diameter section 202. A ring-shaped valve-switching groove 205 is formed in an approximately middle region between the large-diameter sections 201 and 202.

The outer diameter of the medium-diameter section 203 of the piston is set larger than that of the small-diameter section 204 of the piston. As a result, regarding the pressure-receiving area of the piston 200 in a piston front chamber 110 and that in a piston rear chamber 111, in other words, the diametrical difference between the large-diameter section 201 and the medium-diameter section 203 and the diametrical difference between the large-diameter section 202 and the small-diameter section 204, the difference in the piston rear chamber 111 is larger.

The piston 200 is slidingly fitted in the cylinder 100, thereby defining the piston front chamber 110 and the piston rear chamber 111 within the cylinder 100. The piston front chamber 110 is always connected to a high pressure circuit 101 via a piston front chamber passage 120. On the other hand, the piston rear chamber 111 can communicate alternatingly with either the high pressure circuit 101 or a low pressure circuit 102 via the piston rear chamber passage 121 by switching a switching-valve mechanism 130 to be described later.

A pump P is connected to the high pressure circuit 101, in the middle of which is provided a high pressure accumulator 140. A tank T is connected to the low pressure circuit 102, in the middle of which is provided a low pressure accumulator 141. The switching-valve mechanism 130 is a known switching valve disposed in a suitable position inside or outside the cylinder 100, and is operated by pressurized oil supplied/discharged via a valve-control passage 122 to be described later, thereby switching high and low pressures in the piston rear chamber 111 alternatingly.

A piston-advancing control port 112, a piston-retreating control port 113, and an oil-discharging port 114 are provided from front toward rear separately from each other at a certain interval between the piston front chamber 110 and the piston rear chamber 111. The piston-advancing control port 112 and the piston-retreating control port 113 are connected to respective passages branched from the valve-control passage 122. The oil-discharging port 114 is connected to the tank T via an oil-discharging passage 123.

In front of the cylinder 100, a front head 300 is disposed, in which a rod 310 is slidingly fitted so as to be movable backwards and forwards. The front head 300 includes a hammering chamber 301 formed therein, in which the rear end of the rod 310 is hammered by the front end of the piston 200.

A back head 400 is disposed behind the cylinder 100. The back head 400 includes a retreat chamber 401 and a pressurizing chamber 402 behind the retreat chamber, both formed therein. The inner diameter of the retreat chamber 401 is set so as not to influence the backward and forward movement of the small-diameter section 204 of the piston, and the inner diameter of the pressurizing chamber 402 is set to be larger than that of the retreat chamber 401. The end surface 403 is formed on the boundary between the retreat chamber 401 and the pressurizing chamber 402.

An acceleration piston 410 as an urging means is slidingly fitted to the pressurizing chamber 402. The acceleration piston 410 has an anterior small-diameter section 411 and a posterior large-diameter section 412. A stepped surface 413 is formed on the boundary between the small-diameter section 411 and the large-diameter section 412. The large-diameter section 412 slidingly coming into contacting with the inner diameter of the pressurizing chamber 402 and the end surface 403 coming into contact with the stepped surface 413 form a hydraulic chamber behind the large-diameter section 412 in the pressurizing chamber 402, and the hydraulic chamber is always connected to the high pressure circuit 101 via the pressurizing passage 404.

In general hydraulic hammering devices, the hammering surface of the rod 310 and that of the piston 200, in other words, the outer diameter of the medium-diameter section 203 of the piston and the outer diameter of the rear end part of the rod 310 are set to be of the same size substantially. The reason for this is to enhance the transmission efficiency of stress wave generated by the rod 310 hammered by the piston 200, and for the same reason in this embodiment, the outer diameter of the small-diameter section 411 of the acceleration piston 410 is set to be nearly of the same size as that of the small-diameter section 204 of the piston.

Next, the operation of the hydraulic hammering device of this embodiment and operating states of the acceleration piston 410 will be explained with reference to FIGS. 2A to 2F. In FIGS. 2A to 2F, regions to which the circuit is connected in a highly-pressurized state are indicated by thick solid lines and hatching.

In the hydraulic hammering device of this embodiment, the piston front chamber 110 is always connected in a highly pressurized state, thereby always urging the piston 200 backward; when the piston rear chamber 111 is connected in the highly pressurized state owing to the operation of the switching-valve mechanism 130, the piston 200 advances owing to the pressure-receiving area difference, and when the piston rear chamber 111 is connected in a low pressurized state owing to the operation of the switching-valve mechanism 130, the piston 200 retreats.

When the piston-advancing control port 112 communicates with the piston front chamber 110 to supply pressurized oil to the valve-control passage 122, the switching-valve mechanism 130 is switched to a position such that the piston rear chamber passage 121 communicates with the high pressure circuit 101, and when the piston-retreating control port 113 communicates with the oil-discharging port 114 to discharge pressurized oil to the tank T from the valve-control passage 122, it is switched to a position such that the piston rear chamber passage 121 communicates with the low pressure circuit 102.

Here, the hammering mechanism of hydraulic hammering device of this embodiment is characterized in that the acceleration piston 410 is provided in the back head 400 in comparison with conventional hydraulic hammering devices.

Figure 2:
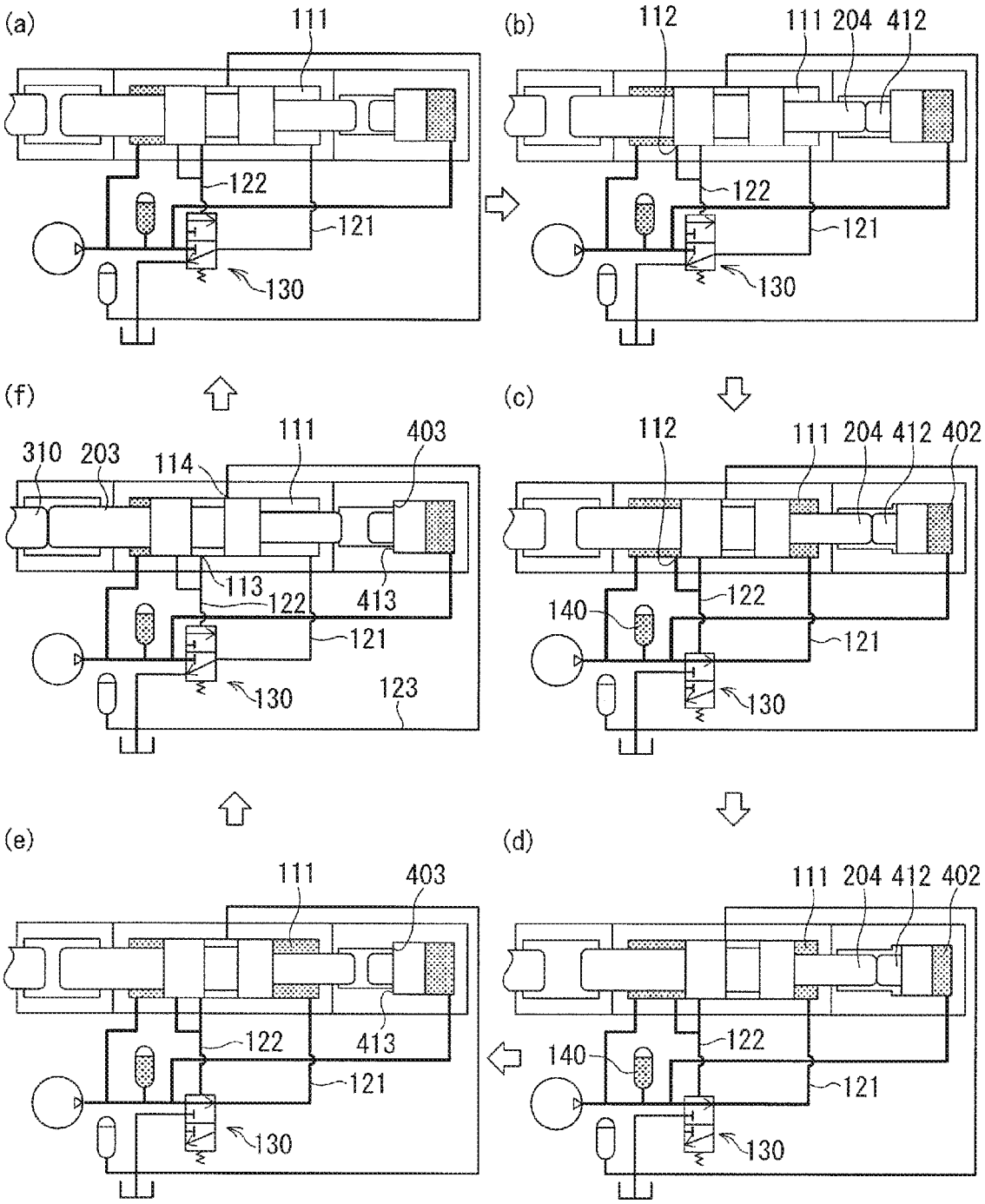
FIGS. 2A to 2F are schematic diagrams indicating operating states of the first embodiment.

In other words, upon the hammering of the rod 310 by the piston 200, as illustrated in FIG. 2F, a pilot chamber (not illustrated) of the switching-valve mechanism 130 is connected to a low pressure state via the valve-control passage 122 and the oil-discharging passage 123. Therefore, the internal spool of the pilot chamber is switched so that the piston rear chamber passage 121 communicates with the low pressure circuit 102, to make the piston rear chamber 111 be in the low pressure state, resulting in the start of the retreat operation of the piston 200 (See FIG. 2A).

Then, in the hydraulic hammering device of the present embodiment, before the piston 200 retreats and the piston-advancing control port 112 opens during one piston retreat stroke, i.e., at a timing before the piston 200 is braked after the switching-valve mechanism 130 is switched and thereby the rear chamber 111 enters the high pressure state, the piston 200 comes in contact with the accelerating piston 410. As a result, a thrust (referred to as "auxiliary thrust") by the accelerating piston 410 of the present embodiment acts on the piston 200 (see FIG. 2B).

The piston 200 further continues to retreat, the piston-advancing control port 112 is opened to switch the switching-valve mechanism 130, and the piston rear chamber 111 enters the high pressure state, whereby the piston 200 is braked. As a result, the above-mentioned auxiliary thrust and a thrust (referred to as "normal thrust") due to a pressure-receiving area difference between the front chamber 110 and the rear chamber 111 are added up and act on the piston 200 (see FIG. 2C).

Even after that, the piston 200 continues to retreat by inertia. However, since the above-mentioned auxiliary thrust and normal thrust are added up and act on the piston 200, the piston 200 turns from retreat to advance at a position further ahead than a normal rearward stroke end. During the time, the pressurized oil discharged from the pressurizing chamber 402 is accumulated in the high pressure accumulator 140 (see FIG. 2D).

Immediately after the piston 200 has turned to advance, the pressurized oil accumulated in the high pressure accumulator 140 is quickly supplied to the pressurizing chamber 402. Due to this, the piston 200 is strongly urged by the acceleration piston 410, and is quickly accelerated. Until, subsequently, the stepped surface 413 comes in contact with the end surface 403 and reaches a forward stroke end of the acceleration piston 410, the auxiliary thrust by the acceleration piston 410 and the normal thrust due to the pressure-receiving area difference between the front chamber 110 and the rear chamber 111 are added up and act on the piston 200. Thus, the acceleration has a large value due to the added auxiliary thrust (from FIG. 2D to 2E).

Then, when the stepped surface 413 comes in contact with the end surface 403 and reaches the forward stroke end of the acceleration piston 410, the piston 200 moves away from the acceleration piston 410, advances only with the normal thrust (FIG. 2E), then reaches a predetermined hammering position, and hammers the rod 310 (FIG. 2F). Hereinafter, the above-described cycle will be repeated to continuously perform hammering operation.

Figure 3:
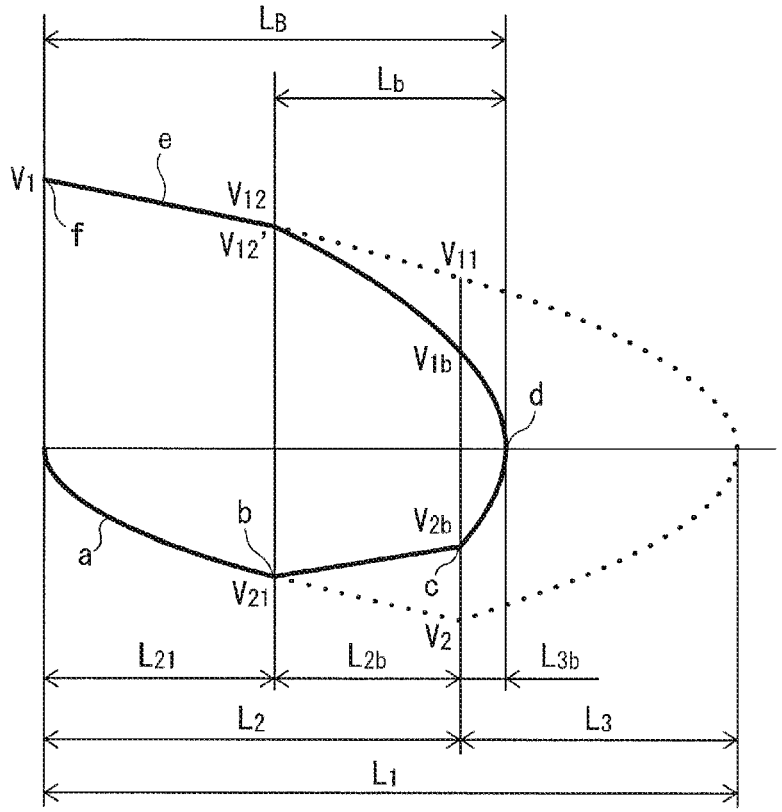
FIG. 3 is a piston displacement-speed chart of the first embodiment.
Figure 9:
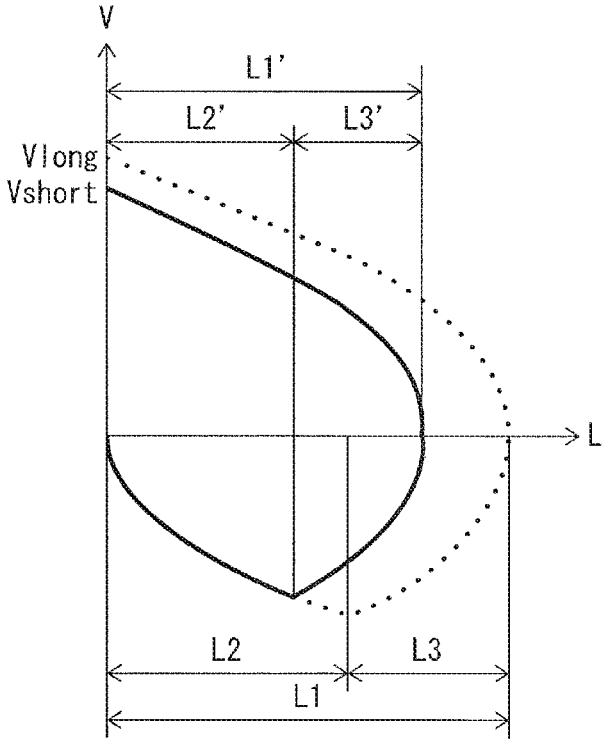
FIG. 9 is a displacement-speed chart of the conventional hydraulic hammering device.

FIG. 3 illustrates a displacement-speed chart of the hydraulic hammering device of the present embodiment. The drawing also includes, for reference, a case without the acceleration piston 410 of the present embodiment, which is indicated by a broken line (a rightmost chart in the drawing). The broken-line portion has the same profile as that of the chart of the long stroke specifications in the conventional hydraulic hammering device (FIG. 9), in which respective strokes are indicated by $L_1$ to $L_3$. Note that, for descriptive convenience, the aspect ratio in FIG. 3 is different from that in FIG. 9.

In the relationship between the displacement-speed chart illustrated in FIG. 3 and FIGS. 2A to 2F, the time period from the retreat of the piston 200 to the contact thereof with the acceleration piston 410 corresponds to a section $L_{21}$ (FIG. 2A). Additionally, the time period from the contact of the piston 200 with the acceleration piston 410 (FIG. 2B) until the piston 200 retreats while being braked and then the rear chamber 111 is switched to high pressure (FIG. 2C), i.e., a state where only retreat force by front chamber pressure and the auxiliary thrust act on the piston 200 during retreat acceleration corresponds to a section $L_{2b}$. Furthermore, a section of retreat up to the rearward stroke end (FIG. 2D), i.e. a section for deceleration of retreating piston where the thrust obtained by adding up the auxiliary thrust and the normal thrust acts on the piston 200 corresponds to a section $L_{3b}$.

In addition, the time period from the turning of the piston 200 to advance from the rearward stroke end (FIG. 2D) to the separation thereof from the acceleration piston 410 (FIG. 2E), i.e., an advance-acceleration section where the normal thrust and the auxiliary thrust are added up and act on the piston 200 corresponds to a section Lb. Furthermore, a period until the piston 200 advances and hammers the rod 310 (FIG. 2F), i.e., an advance-acceleration section where only the normal thrust acts on the piston 200 corresponds to an upper half of the section $L_{21}$.

As illustrated in FIG. 3, the hydraulic hammering device of this embodiment operates as a hammering mechanism specified as a long-stroke type except in the section during which the piston 200 is in contact with the acceleration piston 410. It can be seen that, while a maximum speed at the time of retreat changes from $V_2$ to $V_{21}$, the speed of the piston 200 at the time when hammering the rod 310 remains unchanged at $V_1$.

Now, a mechanism of the hydraulic hammering device of the present invention will be examined.

First, the piston hammering speed is not influenced by the contact position with the acceleration piston 410.

Piston mass is defined as m, front chamber pressure-receiving area as $S_f$, rear chamber pressure-receiving area as $S_r$, acceleration piston pressure-receiving area as $S_b$, and hammering pressure as $P_w$. When the front and rear chamber pressure-receiving area difference $\Delta S=S_r-S_f$ a ratio of the front chamber pressure-receiving area $S_f$ to $\Delta S$ is defined as n.

As illustrated in FIG. 3, in the hydraulic hammering device whose valve switching position is located at a distance of $L_2$ from a hammering point, when the acceleration piston 410 comes in contact with the piston 200 before $L_{2b}$ ahead of the valve switching position, a piston retreat maximum speed at the time of valve switching in the case without the acceleration piston is defined as $V_2$, a piston kinetic energy at that time is defined as $E_2$, and a piston speed at the time of collision with the acceleration piston 410 is defined as $V_{21}$. A piston kinetic energy $E_{21}$ at that time is expressed by the following formula (1):

$$E_{21}=\tfrac{1}{2}mV_{21}^2=S_fP_wL_{21}=n\Delta SP_wL_{21}=\tfrac{1}{2}mV_2^2-S_fP_wL_{2b}=E_2-n\Delta SP_wL_{2b} \quad (1)$$

In addition, when a piston speed at the time when the piston retreated to the valve switching position after being contact with the acceleration piston 410 is defined as $V_{2b}$, a piston kinetic energy $E_{2b}$ at that time is expressed by the following formula (2):

$$E_{2b}=\tfrac{1}{2}mV_{2b}^2=E_{21}+(S_f-S_b)P_wL_{2b}=E_{21}+(n\Delta S-S_b)P_wL_{2b} \quad (2)$$

On the other hand, in the advance stroke of the piston 200 integrated with the acceleration piston 410, a piston speed at the time when passing through the valve switching position is $V_{1b}$, so that a piston kinetic energy $E_{1b}$ at that time is expressed by the following formula (3):

$$E_{1b}=E_{2b}=\tfrac{1}{2}mV_{wb}^2=E_{21}+(n\Delta S-S_b)P_wL_{2b} \quad (3)$$

Furthermore, when a piston speed at a moment when the piston 200 moves away from the acceleration piston 410 in the advance stroke is defined as $V_{12}$, a piston kinetic energy $E_{12}$ at that time is expressed by the following formula (4):

$$E'_{12} = E_{1b} + (S_r + S_b - S_f)P_W L_{2b} = E_{1b} + (\Delta S + S_b)P_W L_{2b} = E_{21} + (n\Delta S - S_b)P_W L_{2b} + (\Delta S + S_b)P_W L_{2b} = E_{21} + (1+n)\Delta SP_W L_{2b} \quad (4)$$

Formula (1) is substituted in formula (4) to obtain the following formula (5):

$$E_{12}' = E_2 - n\Delta SP_w L_{2b} + (1+n)\Delta SP_w L_{2b} = E_2 + \Delta SP_w L_{2b} \quad (5)$$

On the other hand, in the advance stroke of the case without the acceleration piston, a piston speed at the time when passing through the valve switching position is $V_{11} = -V_2$. Therefore, a piston kinetic energy $E_{11}$ at that time is expressed by the following formula (6):

$$E_{11} = E_2 = \tfrac{1}{2} m V_2^2 \quad (6)$$

Furthermore, a piston kinetic energy $E_{12}$ after advancing by $L_{2b}$ is expressed by the following formula (7):

$$E_{12} = E_{11} + \Delta SP_w L_{2b} = E_2 + \Delta SP_w L_{2b} \quad (7)$$

Formula (7) is equal to formula (5). Specifically, a piston kinetic energy $E_{12'}$ at the time when the piston 200 integrated with the acceleration piston 410 moves away from the acceleration piston 410 in the advance stroke is equal to the piston kinetic energy $E_{12}$ at the time when the piston without the acceleration piston passes through the same position in the advance stroke. In other words, it is indicated that the piston speed does not change.

Now, when the case with the acceleration piston is compared with the case without the acceleration piston, in the case with the acceleration piston, a work $E_B$ in which the acceleration piston 410 reduces the piston kinetic energy in the retreat stroke and a work $E_F$ in which, conversely, it increases the piston kinetic energy in the advance stroke are the same in absolute value, although different in merely direction, regardless of the position of collision with the piston 200. In short, $$|E_B| = |E_F| = S_b P_w (L_{2b} + L_{3b})$$

Accordingly, these are offset. In other words, the kinetic energy of the piston 200 before and after being contact with the acceleration piston 410 is the same as that in the case without the acceleration piston.

Second, a hammering cycle calculation formula is discussed.

Figure 4:
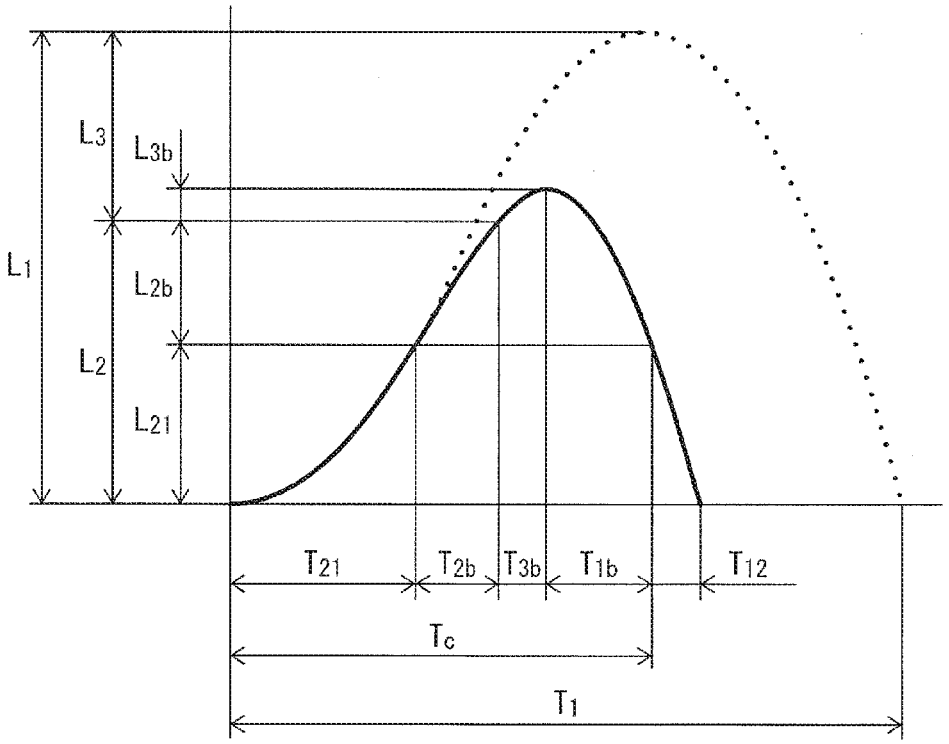
FIG. 4 is a time-displacement chart of the first embodiment.

In FIG. 4, a required time of each stroke is obtained. First, a relationship between an impulse acting on the piston 200 in the retreat stroke section $L_{21}$ and momentum change is expressed by the following formula (8):

$$mV_{21} = S_f P_w T_{21} = n\Delta SP_w T_{21} \quad (8)$$

Additionally, a relationship between work and kinetic energy is expressed by the following formulae (9) and (10):

$$\frac{1}{2} m V_{21}^2 = S_f P_W L_{21} = n\Delta SP_W L_{21} \quad (9)$$

$$\therefore V_{21} = \sqrt{\frac{2n\Delta SP_W L_{21}}{m}} \quad (10)$$

With substitution of formula (10) in formula (8), a required time $T_{21}$ of the retreat stroke section $L_{21}$ is expressed by the following formula (11):

$$T_{21} = \sqrt{\frac{2mL_{21}}{n\Delta SP_W}} \quad (11)$$

Next, a relationship between an impulse acting on the piston 200 in the retreat stroke section $L_{2b}$ and momentum change is expressed by the following formula (12):

$$m(V_{2b} - V_{21}) = (S_f - S_b)P_w T_{2b} = (n\Delta S - S_b)P_w T_{2b} \quad (12)$$

In addition, a relationship between work and kinetic energy is expressed by the following formulae (13) and (14):

$$\frac{1}{2} m V_{2b}^2 = S_f P_W L_{21} + (S_f - S_b)P_W L_{2b} = n\Delta SP_W L_2 - S_b P_W L_{2b} = (S_r + S_b - S_f)P_W L_{3b} = (\Delta S + S_b)P_W L_{3b} \quad (13)$$

$$\therefore V_{2b} = \sqrt{\frac{2(\Delta S + S_b)P_W L_{3b}}{m}} \quad (14)$$

With substitution of formulae (10) and (14) in formula (12), a required time $T_{2b}$ of the retreat stroke section $L_{2b}$ is expressed by the following formula (15):

$$T_{2b} = \frac{\sqrt{2m(\Delta S + S_b)P_W L_{3b}} - \sqrt{2mn\Delta SP_W L_{21}}}{(n\Delta S - S_b)P_W} \quad (15)$$

Next, a relationship between an impulse acting on the piston 200 in the retreat stroke section $L_{3b}$ and momentum change is expressed by the following formula (16):

$$mV_{2b} = (\Delta S + S_b)P_w T_{3b} \quad (16)$$

With substitution of formula (14) in formula (16), a required time $T_{3b}$ of the retreat stroke section $L_{3b}$ is expressed by the following formula (17):

$$T_{3b} = \sqrt{\frac{2mL_{3b}}{(\Delta S + S_b)P_W}} \quad (17)$$

Next, a relationship between an impulse acting on the piston 200 in the advance stroke section $L_{3b}+L_{2b}$ (i.e., $L_b$ in FIG. 3) and momentum change is expressed by the following formula (18):

$$mV_{1b} = (\Delta S + S_b)P_w T_{1b} \quad (18)$$

Additionally, a relationship between work and kinetic energy is expressed by the following formulae (19) and (20):

$$\frac{1}{2} m V_{1b}^2 = (\Delta S + S_b)P_W (L_{3b} + L_{2b}) \quad (19)$$

$$\therefore V_{1b} = \sqrt{\frac{2(\Delta S + S_b)P_W (L_{3b} + L_{2b})}{m}} \quad (20)$$

With substitution of formula (20) in formula (18), a required time $T_{1b}$ of the advance stroke section $L_{3b}+L_{2b}$ is expressed by the following formula (21):

$$T_{1b} = \sqrt{\frac{2m(L_{3b} + L_{2b})}{(\Delta S + S_b)P_W}} \tag{21}$$

Lastly, a relationship between an impulse acting in the advance stroke section $L_{21}$ and momentum change is expressed by the following formula (22):

$$m(V_1 - V_{1b}) = \Delta S P_w T_{12} \tag{22}$$

A relationship between work and kinetic energy is expressed by the following formulae (23) and (24):

$$\frac{1}{2}mV_1^2 = (S_r - S_f)P_W L_1 = \Delta S P_W L_1 \tag{23}$$

$$\therefore V_1 = \sqrt{\frac{2\Delta S P_W L_1}{m}} \tag{24}$$

With substitution of formulae (20) and (24) in formula (22), a required time $T_{21}$ of the advance stroke section $L_{21}$ is expressed by the following formula (25):

$$T_{12} = \frac{\sqrt{2m\Delta S P_W L_1} - \sqrt{2m(\Delta S + S_b)P_W(L_{3b} + L_{2b})}}{\Delta S P_W} \tag{25}$$

Formulae (11), (15), (17), (21), and (25) are added up to obtain one hammering cycle Tc, which is expressed by the following formula (26):

$$T_C = T_{21} + T_{2b} + T_{3b} + T_{1b} + {}_{12} \tag{26}$$

As can be understood from formula (26), the one hammering cycle Tc is a function of the hammering pressure, the piston mass, the front and rear chamber pressure-receiving areas, the piston stroke, the valve switching position, and furthermore, the pressure-receiving area of the acceleration piston 410, and the position of the collision.

Actually, regarding several combinations of the piston 200 and the acceleration piston 410 that are different in specifications, the contact position was changed to calculate the hammering frequency. When focusing on a relationship between the position of the collision and the hammering frequency, generally, the hammering frequency increases as the timing of the contact is set to be earlier than the timing of valve switching (in other words, as the contact position is shifted further ahead than the valve switching position), but peak is reached at a certain timing or position, and when the hammering frequency exceeds the peak, it conversely tends to decrease. Change rate of the hammering frequency and the position where the peak is reached vary depending on the specifications of the piston 200, i.e., the relationship between the front and rear chamber pressure-receiving areas and the pressure-receiving area of the acceleration piston 410.

Figure 5:
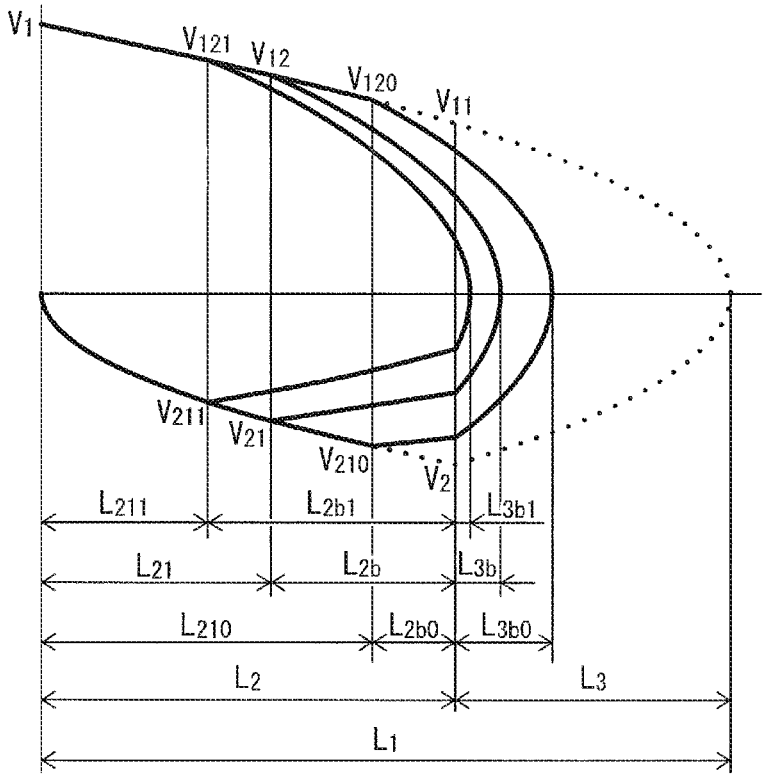
FIG. 5 is a displacement-speed chart of the first embodiment, which chart illustrates cases where a contact position between an acceleration piston and a hammering piston was changed.

FIG. 5 illustrates cases where the contact position between the piston 200 and the acceleration piston 410 was changed back and forth with reference to FIG. 3, without changing the specifications of the piston 200 and the acceleration piston 410.

As can be seen from FIG. 5, when the contact position L21 is changed to L210 and L211, the piston speed at the time of the contact changes from V21 to V210 and V211, and the stroke L2*b* up to valve switching changes to L2*b*0 and L2*b*1. In addition, the piston speed V12 at the time when the piston 200 moves away from the acceleration piston 410 changes to V120 and V121. However, in either case, the chart of the subsequent stroke speed draws the same trajectory as that in the case without the acceleration piston. Therefore, the piston hammering speed V1 is constant.

Figure 6:
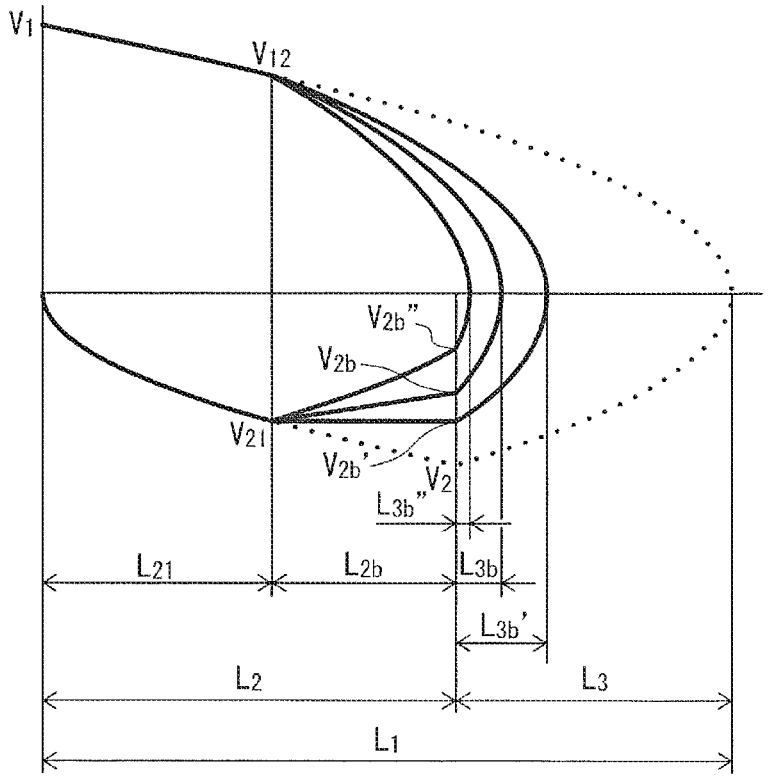
FIG. 6 is a displacement-speed chart of the first embodiment, which chart illustrates cases where a thrust ratio between the acceleration piston and the hammering piston was changed.

FIG. 6 illustrates cases where while the contact position L21 between the piston 200 and the acceleration piston 410 was fixed, the specifications of the piston 200 and the acceleration piston 410 were changed with reference to FIG. 3.

As can be seen from FIG. 6, when the thrust of the acceleration piston 410 is increased or decreased relative to the thrust at the time of retreat of the piston, the piston speed at the time of the valve retreat switching changes from $V_{2b}$ to $V_{2b'}$ and $V_{2b''}$, the stroke $L_{3b}$ from a valve retreat switching position up to a rear dead center of the piston changes to $L_{3b'}$ and $L_{3b''}$. However, in either case, the stroke speed chart after moving away from the acceleration piston 410 draws the same trajectory. Therefore, the piston hammering speed $V_1$ is constant.

In this way, in the hydraulic hammering device of the present embodiment, stroke shortening can be made. In addition, stroke shortening is made by recovery and discharging of kinetic energy by the high pressure accumulator 140, so that no additional power is required.

Additionally, in the hydraulic hammering device of the present embodiment, even when the stroke is shortened, the piston hammering speed $V_1$ at the time when the piston 200 hammers the rod 310 does not change. This increases the hammering frequency, without reducing a hammering energy per stroke, so that the output of the hammering mechanism can be increased.

Furthermore, in the hydraulic hammering device of the present embodiment, stroke shortening can be made without changing the arrangement of a hydraulic circuit such as the piston control port, so that there occurs no efficiency reduction due to a reduced seal length. The amount of shortening of the stroke can be flexibly set depending on the contact position between the piston 200 and the acceleration piston 410 and the relationship between the retreat thrust of the piston 200 and the thrust of the acceleration piston 410. For example, the stroke shortening amount can be easily controlled by extending or shortening the length of the small-diameter section of the acceleration piston 410 or increasing or decreasing the pressure-receiving area of the acceleration piston 410.

While the one embodiment of the present invention has been described hereinabove with reference to the drawings, the hydraulic hammering device according to the present invention is not limited to the above embodiment. It is obvious that other various modifications and changes of the respective components are permissible without departing from the spirit of the invention.

For example, the piston 200 is not limited to solid one and a through-hole or a stop hole may be formed at the axial central part of the piston 200. Further, the anterior and posterior large-diameter sections of the piston 200 may not be of the same diameter and may have a diametrical difference from each other. Still further, the outer diameter of the small-diameter section of the acceleration piston 410 may not be fitted to the outer diameter of the medium-diameter section of the piston.

In addition, the hydraulic hammering devices according to the embodiments were exemplified by a hydraulic hammering device of so-called a 'rear chamber high/low pressure switching type' which makes the piston 200 advance/retract by switching high and low pressures in the piston rear chamber while always keeping high pressure in the piston front chamber, but it is not limited to this type.

In other words, the hydraulic hammering device according to the present invention is applicable not only to a hydraulic hammering device of so-called a 'front/rear chamber high/low pressure switching type' which makes the piston advance/retract by alternatingly switching high pressure and low pressures in the piston front chamber and the piston rear chamber, respectively, but also to a hydraulic hammering device of so-called a 'front chamber high/low pressure switching type' which makes the piston advance/retract by switching high and low pressures in the piston front chamber while always keeping high pressure in the piston rear chamber.

In addition, for example, the first embodiment has presented the example in which, immediately after the piston 200 has turned to advance, the pressurized oil accumulated in the high pressure accumulator 140 is quickly supplied to the pressurizing chamber 402 via the pressurizing passage 404, whereby the piston 200 is strongly urged by the acceleration piston 410, and accelerated quickly. However, the present invention is not limited thereto. For example, as in a second embodiment illustrated in FIG. 7, an urging accumulator 142 exclusive to the acceleration piston 410 may be further included.

In other words, the second embodiment has a structure different from that of the first embodiment in that, as illustrated in the drawing, a pressurizing passage 404' includes the urging accumulator 142 exclusive to the acceleration piston 410. The urging accumulator 142 is interposed at a position near the pressurizing chamber 402 with respect to the pressurizing passage 404'.

With the structure of the second embodiment, arranging the urging accumulator 142 near the pressurizing chamber 402 can increase accumulator use efficiency, suppress influence on operation of the switching-valve mechanism 130, and achieve further stabilization of operation of the acceleration piston 410.

In other words, the present invention is configured such that the piston 200 comes in contact with the acceleration piston 410 during the retreat stroke thereof, and the braking force by the pressurized oil acting on the piston 200 and the forward thrust acting on the acceleration piston 410 work together to urge the piston 200 forward, thereby shortening the piston stroke. However, contact of the piston 200 with the acceleration piston 410 is accompanied by impact. In other words, collision between both pistons is inevitable.

Herein, in the hydraulic hammering device of the first embodiment illustrated in FIG. 1, when the piston 200 retreats and collides with the acceleration piston 410, the impact is transmitted to the pressurizing passage 404 via the pressurized oil of the pressurizing chamber 402, and reaches the switching-valve mechanism 130. The impact of the pressurized oil acting on the switching-valve mechanism 130 can cause operational instability of the switching-valve mechanism 130.

Figure 7:
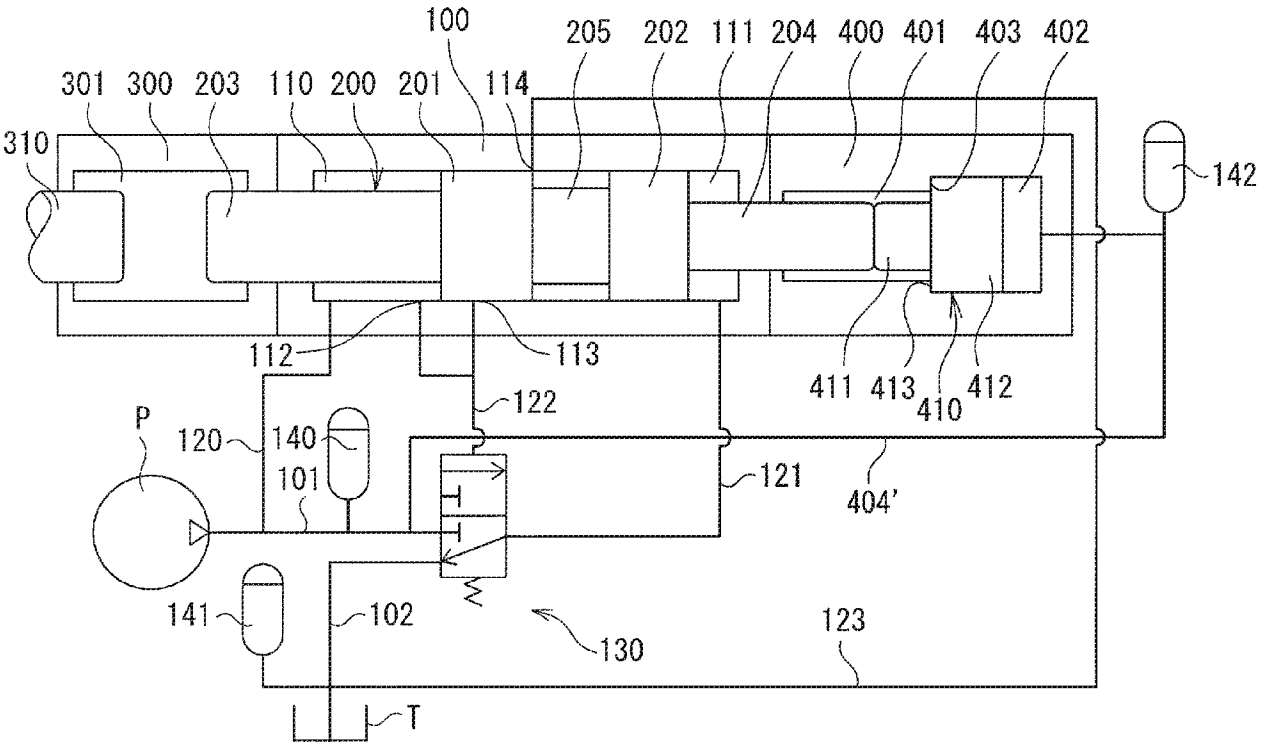
FIG. 7 is a schematic diagram of the second embodiment of a hydraulic hammering device according to an aspect of the present invention.
Figure 8:
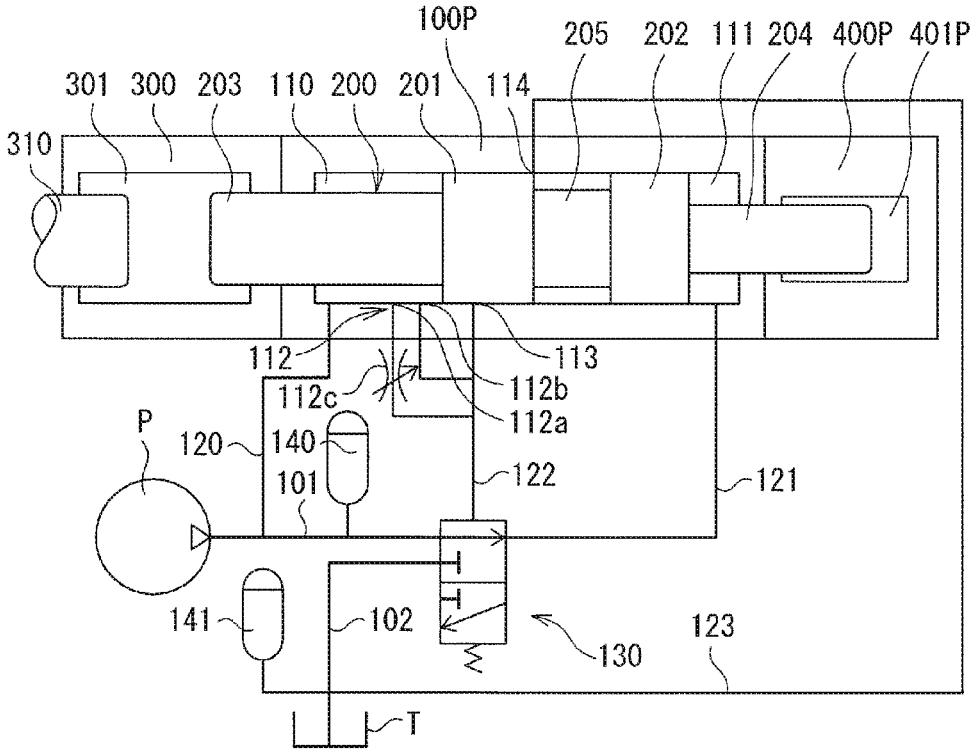
FIG. 8 is a schematic diagram of a conventional hydraulic hammering device.

By contrast with this, in the second embodiment illustrated in FIG. 7, even when impact due to collision between the piston 200 and the acceleration piston 410 is transmitted to the pressurized oil of the pressurizing chamber 402, the impact is buffered by the urging accumulator 142, so that there is no negative influence on operation of the switching-valve mechanism 130. Additionally, since the urging accumulator 142 is provided near the pressurizing chamber 402, the accumulator use efficiency is increased.

Herein, in all of the hydraulic circuits, the larger the passage area is, the smaller the pressure loss is, thus improving hydraulic efficiency. In the hydraulic hammering device of the first embodiment illustrated in FIG. 1, focus will be placed on a relationship between the high pressure passage 121 and the pressure-receiving area of the piston rear chamber 111 and a relationship between the pressurizing passage 404 and the pressure-receiving area of the pressurizing chamber 402. If passage areas of the high pressure passage 121 and the pressurizing passage 404 are set to be the same, it can be seen that the pressurizing passage 404 has a smaller passage area relative to the pressure-receiving area. The fact that the passage area is small relative to the pressure-receiving area indicates large pressure loss. In other words, the pressurizing passage 404 can be said to have a relatively large pressure loss as compared with the high pressure passage 121.

Thus, because the pressure loss on the acceleration piston 410 side is relatively large, the acceleration function of the present invention may not be sufficiently exerted in the stage where the piston 200 and the acceleration piston 410 integrally advance. Increasing the passage area to prevent that has limitations in terms of both cost and layout. Thus, in the second embodiment, preferably, the pressurizing passage 404' connecting the pressurizing chamber 402 to the high pressure circuit 101 further includes a check valve on an upstream side of the urging accumulator 142 (i.e., on the side of pump P which is a source of pressurized oil), the check valve serving as a direction-control means which allows only supply of pressurized oil to the pressurizing chamber 402.

With the structure described above, the direction-control means dramatically improves the use efficiency of the urging accumulator 142. Thus, the above structure is more preferable in that the urging accumulator 142 plays a role as a pressurized oil supply source for exerting the acceleration function of the present invention. In other words, it is unnecessary to consider pressure loss in the pressurizing passage 404', so that the passage area can be set to be small. Additionally, since the use efficiency of the urging accumulator 142 is improved by the direction-control means, the function of buffering the impact of the pressurized oil in the pressurizing chamber 402 as described above is also effectively exerted.

Note that while the check valve has been exemplified as the direction-control means, the same functional effects can be obtained by employing a throttle instead of the check valve. Specifically, resistance generated by the throttle is proportional to the square of the flow speed of pressurized oil passing therethrough. Thus, when comparing inflow to the pressurizing chamber 402 with outflow from the pressurizing chamber 402 to the pump P due to retreat of the acceleration piston 410, the outflow side has an excessively large value. Accordingly, the throttle serves as direction regulating means for allowing only the supply of pressurized oil to the pressurizing chamber 402 side, since when the throttle allows the supply of the pressurized oil to the pressurizing chamber 402 and regulates movement of pressurized oil to an opposite direction, the outflow side has an excessively large value.

The following is a list of reference signs used in the drawings.

100: Cylinder
101: High pressure circuit
102: Low pressure circuit
110: Piston front chamber
111: Piston rear chamber
112: Piston-advancing control port
113: Piston-retreating control port
114: Oil-discharging port
120: Piston front chamber passage
121: Piston rear chamber passage
122: Valve-control passage
123: Oil-discharging passage
130: Switching-valve mechanism
140: High pressure accumulator
141: Low pressure accumulator
142: Urging accumulator
200: Piston
201: Large-diameter section (front)
202: Large-diameter section (rear)
203: Medium-diameter section
204: Small-diameter section
205: Valve-switching groove
300: Front head
301: Hammering chamber
310: Rod
400: Back head
401: Retreat chamber
402: Pressurizing chamber
403: End surface
404: Pressurizing passage
410: Acceleration piston (urging means)
411: Small-diameter section
412: Large-diameter section
413: Stepped surface
P: Pump
T: Tank

The invention claimed is:

1. A hydraulic hammering device comprising:
a cylinder;
a piston slidingly fitted in the cylinder;
a piston front chamber and a piston rear chamber which are defined between an outer circumferential surface of the piston and an inner circumferential surface of the cylinder and disposed separately from each other at front and rear, respectively, in an axial direction of the piston;
a switching-valve mechanism driving the piston by switching at least one of the piston front chamber and the piston rear chamber into communication with at least one of a high pressure circuit and a low pressure circuit; and
a piston control port arranged between the piston front chamber and the piston rear chamber of the cylinder and connected to/disconnected from the high pressure circuit and the low pressure circuit by forward movement/backward movement of the piston, the switching-valve mechanism being driven by pressurized oil supplied/discharged from the piston control port,
wherein the hydraulic hammering device comprises an urging unit disposed behind the piston and configured to come in contact with the piston during a piston retreat stroke to urge the piston forward until an intermediate position of a piston advance stroke after the piston has turned to advance, in which a timing where the urging unit starts to come into contact with the piston is set to be earlier than a timing where the piston is braked by the switching-valve mechanism.

2. The hydraulic hammering device according to claim 1, wherein the urging unit is an acceleration piston, thrust of which is generated by pressurized oil supplied from the high pressure circuit.

3. The hydraulic hammering device according to claim 2, wherein a high pressure accumulator for the high pressure circuit is interposed in the high pressure circuit, the acceleration piston is slidingly fitted in a pressurizing chamber disposed behind the piston, the pressurizing chamber being configured such that the pressurized oil from the high pressure circuit is supplied via a pressurizing passage connected to the high pressure circuit at a position further downstream than a position where the high pressure accumulator is interposed.

4. The hydraulic hammering device according to claim 3, wherein, in the pressurizing passage, an urging accumulator for the acceleration piston is interposed at a position near the pressurizing chamber.

5. The hydraulic hammering device according to claim 4, wherein the pressurizing passage further includes a direction-control unit at a position closer to a pressurized-oil-supply than the urging accumulator and in a vicinity of the urging accumulator, the direction-control unit allowing supply of the pressurized oil to the pressurizing chamber and regulating movement of the pressurized oil in an opposite direction.

6. The hydraulic hammering device of claim 3, further comprising an urging accumulator and a check valve on an upstream side of urging accumulator so that the pressurizing chamber is provided with the pressurized oil and a direction of the pressurized oil is controlled by the check valve.

7. The hydraulic hammering device according to claim 1, wherein normal thrust and auxiliary thrust are added up and act on the piston in an advance-acceleration section until the piston separates from the urging unit.

8. The hydraulic hammering device according to claim 1, wherein the piston includes two large-diameter sections.

9. The hydraulic hammering device according to claim 8, further comprising a ring-shaped valve-switching groove formed in a region between the two large-diameter sections.

10. The hydraulic hammering device according to claim 8, further comprising a medium-diameter section.

11. The hydraulic hammering device according to claim 10, wherein a diametrical difference between one of the two large-diameter sections and the medium-diameter section creates a pressure-receiving area difference.

12. The hydraulic hammering device according to claim 1, wherein the piston front chamber is always connected to the high pressure circuit.

13. The hydraulic hammering device according to claim 12, wherein a portion of the piston located within the piston rear chamber is a small diameter section and a portion of the piston located within the piston front chamber is a medium diameter section.

14. The hydraulic hammering device according to claim 13, wherein when both the piston rear chamber and the piston front chamber are connected to the high pressure circuit the piston is advanced due to an area difference between the small diameter section and the medium diameter section.

15. The hydraulic hammering device according to claim 14, wherein when the piston rear chamber is connected to the low pressure circuit and the piston front chamber is connected to the high pressure circuit the piston moves towards the piston rear chamber.

16. The hydraulic hammering device of claim 1, further including a high pressure accumulator that kinetic energy within the pressurized oil is stored and then released into the urging unit so that no additional power is required to maintain a hammering energy while shortening a stroke of the piston.

* * * * *